US006615902B1

(12) United States Patent
Nishikawa et al.

(10) Patent No.: US 6,615,902 B1
(45) Date of Patent: Sep. 9, 2003

(54) DIE CASTING MACHINE AND DIE CASTING METHOD

(75) Inventors: Koji Nishikawa, Okazaki (JP); Toshihiko Hamada, Okazaki (JP)

(73) Assignee: Denso Corporation, Kariya (JP)

( * ) Notice: Subject to any disclaimer, the term of this patent is extended or adjusted under 35 U.S.C. 154(b) by 0 days.

(21) Appl. No.: 09/577,350

(22) Filed: May 24, 2000

(30) Foreign Application Priority Data

May 31, 1999 (JP) ..... 11-151623
May 31, 1999 (JP) ..... 11-151624
Oct. 13, 1999 (JP) ..... 11-290945

(51) Int. Cl.[7] ..... B22D 17/20
(52) U.S. Cl. ..... 164/267; 164/312
(58) Field of Search ..... 164/72, 267, 149, 164/113, 312

(56) References Cited

U.S. PATENT DOCUMENTS 4,738,297 A * 4/1988 Takagi et al. ..... 164/72
4,770,225 A 9/1988 Takagi et al.
4,955,424 A * 9/1990 Takehisa et al. ..... 164/72
5,842,509 A * 12/1998 Nagashima et al. ..... 164/63
6,039,108 A * 3/2000 Hanano et al. ..... 164/72
6,460,596 B1 * 10/2002 Yamaguchi et al. ..... 164/72

FOREIGN PATENT DOCUMENTS

DE WO 92/17300 * 10/1992 ..... B22D/45/00
EP 06122057 5/1994
JP 55-116761 * 8/1980 ..... B22D/17/14
JP 62-127150 6/1987
JP 3-128158 5/1991
JP 6-83149 11/1994
JP 7-214275 8/1995
JP 9-276981 10/1997
JP 2849807 11/1998
WO WO 92/17300 10/1992

* cited by examiner

*Primary Examiner*—M. Alexandra Elve
*Assistant Examiner*—Kevin P. Kerns
(74) *Attorney, Agent, or Firm*—Posz & Bethards, PLC

(57) ABSTRACT

A die casting machine includes vacuum tank 26 and vacuum pump 27 that together evacuate the inside of a mold cavity 40 to a first degree of vacuum, and vacuum tank 21 and vacuum pump 22 that together evacuate the cavity to a second degree of vacuum higher than the first degree of vacuum. The cavity 40 is connected to vacuum tanks 21 and 26 for evacuating the cavity 40 through an evacuation passage 17. When solenoid valves 19 and 24 open and the cavity is evacuated, a powder mold releasing agent is supplied by a powder feeding apparatus 30 into the cavity 40. Filters 20 and 25 each having a filter diameter smaller than a mean grain diameter of the powder mold releasing agent are interposed between the solenoid valves 19, 24 and the vacuum tanks 21, 26, respectively. When the vacuum tanks 21 and 26 evacuate the cavity 40, filters 20 and 25 capture the major proportion of the powder mold releasing agent, and the occurrence of trouble in the vacuum tanks, etc, can be prevented.

10 Claims, 6 Drawing Sheets

DIE CASTING MACHINE AND DIE CASTING METHOD

BACKGROUND OF THE INVENTION

1. Field of the Invention

This invention relates to a die casting machine and a die casting method that use a powder mold releasing agent as a mold releasing agent for easily releasing a cast from a mold.

2. Description of the Related Art

Japanese Unexamined Patent Publication (Kokai) No. 62-127150 discloses a die casting machine for conducting die casting by using a powder mold releasing agent. In this die casting machine, a mold comprising a fixed mold and a movable mold is clamped, and the inside of a mold cavity is evacuated through an exhaust port communicating with the cavity after this mold clamping. A mold releasing agent such as a powder mold releasing agent is supplied and applied into the mold cavity under the vacuum state through a sleeve.

The powder mold releasing agent provides various advantages in comparison with a liquid mold releasing agent. For example, when the liquid mold releasing agent is heated by a molten charge, the amount of heat decomposition gases is large, causing casting porosity in the die cast product. The powder mold releasing agent can decrease the occurrence of such casting porosity. The liquid mold releasing agent is generally sprayed, using an air flow, onto the mold surface. However, this method generates mist and noise and deteriorates the working environment. When the liquid mold releasing agent is sprayed, the temperature of the mold that is heated by the molten charge drops drastically, and the temperature change of the mold in one cycle of die casting becomes greater. As a result, life of the mold drops and hair line cracks, etc, occur at a relatively early stage.

In contrast, when the powder mold releasing agent is used, as in the prior art example described above, the mold releasing agent is applied after mold clamping. Therefore, the scatter of the mold releasing agent outside the mold can be reduced. As a result, the powder mold releasing agent can be applied efficiently and the deterioration of the working environment can be prevented. Furthermore, the life of the mold can be increased because the temperature change of the mold in the casting cycle can be reduced.

When die casting is conducted, the inside of the cavity is evacuated in advance to a high vacuum, in some cases, in order to prevent the occurrence of casting porosity resulting from the entrapment of air. Since the air must be purged sufficiently at this time, the degree of vacuum is preferably as high as 20 to 50 Torr.

The inventors of the present invention have confirmed that such a high vacuum need not be established when the powder mold releasing agent is sucked into the cavity. The powder mold releasing agent must be sucked into the cavity and must remain there. If the powder mold releasing agent is sucked at an excessively high degree of vacuum, the amount of the powder mold releasing agent reaching the vacuum apparatus through the cavity increases notwithstanding the requirement that it must be sucked and remain in the cavity. The degree of vacuum required for sucking the powder mold releasing agent into the cavity is 700 to 750 Torr, for example.

The vacuum apparatus for evacuating the inside of the cavity to a high vacuum generally comprises a vacuum tank and a vacuum pump because a vacuum pump having an extremely high capacity must be employed to directly evacuate the cavity by the vacuum pump alone, and the cost of the apparatus increases. Therefore, the vacuum pump and the vacuum tank are combined with each other so that the vacuum pump can gradually reduce the pressure of the vacuum tank. When the degree of vacuum reaches a desired level in the vacuum tank, the vacuum tank is communicated with the cavity to evacuate the inside of the cavity. The following problems arise when such a vacuum apparatus is used to establish both the degree of vacuum necessary for sucking the powder mold releasing agent and the degree of vacuum necessary for air exhaust when the molten charge is ejected.

Once the vacuum tank is communicated with the cavity, the degree of vacuum inside the vacuum tank drops greatly. Therefore, a relatively long time is necessary after the vacuum tank is communicated with the cavity for sucking the powder mold releasing agent and before the degree of vacuum inside the vacuum tank reaches a level necessary for exhausting the cavity. As a result, the casting cycle of the die cast products is long and the productivity drops.

On the other hand when the capacity of the vacuum apparatus is increased (greater capacity of the vacuum tank and greater suction capacity of the vacuum pump) to cope with this problem, the cost of the vacuum apparatus increases drastically.

When a powder molding agent is used as the molding agent, however, the molding agent sucked into the cavity does not necessarily adhere as a whole to the cavity surface, and a part is discharged from the exhaust port of the cavity. When the powder mold releasing agent thus discharged is built up in the vacuum pump and vacuum tank for evacuating the cavity, the desired degree of vacuum cannot be obtained, and trouble in the vacuum pump is more likely to occur.

In the die casting machine of the prior art described above, the powder mold releasing agent is supplied through a sleeve (a feed runner). A plunger for ejecting the molten charge supplied into the cavity is disposed inside this sleeve. The plunger slides inside the sleeve at the time of ejection of the molten charge. Therefore, a lubricant is preferably supplied to insure smooth sliding of the plunger.

However, the lubricant generally has viscosity and when the powder mold releasing agent is supplied, the powder mold releasing agent may be deposited into the sleeve. If the powder mold releasing agent builds up inside the sleeve, the powder molding agent is pushed out into the cavity together with the molten charge when the latter is supplied, and may mix into the die cast product.

SUMMARY OF THE INVENTION

It is therefore an object of the present invention to provide a die casting machine and a die casting method that can conduct satisfactorily die casting even when a powder mold releasing agent is used as a mold releasing agent.

It is another objector the present invention to provide a die casting machine and a die casting method that can prevent a casting cycle from being long and can minimize a rise in the cost of a vacuum apparatus even when the inside of a cavity is evacuated for sucking a powder mold releasing agent and even when a vacuum condition is established to prevent air from being entrapped into a molten charge.

A die casting machine according to one embodiment of the present invention comprises a mold, including a fixed mold and a movable mold, forming a cavity when the fixed mold and the movable mold are clamped; evacuation means connected to the cavity through an evacuation passage, for evacuating the inside of the cavity to a predetermined degree of vacuum; switching means disposed in the evacuation passage, for opening and closing the evacuation passage; powder mold releasing agent feeding means for supplying the powder mold releasing agent into the cavity when the switching means is closed and when the inside of the cavity is evacuated to the predetermined degree of vacuum, and applying the powder mold releasing agent to the surface of the cavity; a first filter interposed between the switching means and the evacuation means, and having a filter diameter smaller than at least a mean grain diameter of the powder mold releasing agent; and molten charge feeding means for supplying a molten charge into the cavity after the powder mold releasing agent is applied to the surface of the cavity.

As described above, the first filter having a filter diameter smaller than the mean grain diameter of the powder mold releasing agent is interposed between the switching means and the evacuation means. Consequently, even when the switching means is closed and the evacuation means evacuates the inside of the cavity, the major proportion of the powder mold releasing agent in excess are collected by the first filter. Because the powder mold releasing agent is thus substantially prevented from reaching the evacuation means, a trouble, such as a failure to reach the desired degree of vacuum, can be prevented.

A die casting method for conducting die casting by clamping a fixed mold and a movable mold to define a cavity and supplying a molten charge into the cavity from a sleeve according to one embodiment of the present invention comprises a first step of supplying a powder mold releasing agent into the cavity through the sleeve; a second step of supplying a lubricant for a plunger sliding inside the sleeve, after the first step; a third step of supplying the molten charge into the sleeve and ejecting the molten charge by the plunger into the cavity after the second step; and a fourth step of withdrawing a metal mold product solidified inside the cavity.

In this method, as the powder mold releasing agent is supplied into the cavity through the sleeve when the inside of the sleeve is in a dry condition, the powder mold releasing agent is not built up inside the sleeve. The lubricant is supplied into the sleeve for the plunger, and smoothly slides inside the sleeve, after the powder mold releasing agent is supplied.

A die casting machine according to another embodiment of the present invention comprises a mold, including a fixed mold and a movable mold, and forms a cavity when the fixed mold and the movable mold are clamped; powder mold releasing agent feeding means for supplying a powder mold releasing agent into the cavity; first evacuation means connected to an exhaust port of the cavity through a first evacuation passage, for evacuating the inside of the cavity to a first predetermined degree of vacuum and sucking the powder mold releasing agent supplied from the powder mold releasing agent feeding means into the cavity; second evacuation means connected to the exhaust port of the cavity through a second evacuation passage, for evacuating the inside of the cavity to a second predetermined degree of vacuum higher than the first degree of vacuum after the powder mold releasing agent is applied to the surface of the cavity; and molten charge feeding means for supplying the molten charge into the cavity when the second evacuation means evacuates the cavity to the second predetermined degree of vacuum.

The first degree of vacuum for sucking the powder mold releasing agent is established by the first evacuation means. The second degree of vacuum for purging the air inside the cavity to prevent the air from being entrapped by the molten charge is established by the second evacuation means. The first and second degrees of vacuum are attained by the first and second evacuation means that are provided independently of each other. Therefore, a waiting time for acquiring the predetermined degree of vacuum is not needed. In consequence, the casting cycle can be prevented from becoming long.

Further, the present invention takes the difference between the first degree of vacuum, for sucking the powder mold releasing agent, and the second degree of vacuum, for purging the air inside the cavity to prevent air from being entrapped into the molten charge, into specific consideration. When the powder mold releasing agent is sucked into the cavity, a high degree of vacuum required for achieving the high vacuum state for preventing entrapment of air into the molten charge is not necessary. In this case, the first evacuation means is so set as to attain a lower degree of vacuum than the second evacuation means. Therefore, although two independent evacuation means are provided, the increase in the cost can be restricted.

A die casting method for conducting die casting by supplying a molten charge from a sleeve into a cavity that is formed when a fixed mold and a movable mold are clamped, according to another embodiment of the present invention, comprises a first step of evacuating the inside of the cavity to a first predetermined degree of vacuum by first evacuation means; a second step of sucking a powder mold releasing agent supplied through the sleeve into the cavity by utilizing the first degree of vacuum; a third step of evacuating the inside of the cavity to a second predetermined degree of vacuum higher than the first predetermined degree of vacuum, by second evacuation means disposed separately from the first evacuation means; a fourth step of ejecting the molten charge, that is supplied into the sleeve, into the cavity evacuated to the second degree of vacuum, by a plunger sliding inside the sleeve; and a fifth step of withdrawing a metal mold product solidified inside the cavity.

The die casting method of the present invention described above can prevent the casting cycle from becoming long while the increase of the cost is restricted.

The present invention may be more fully understood from the description of preferred embodiments of the invention set forth below, together with the accompanying drawings.

DESCRIPTION OF THE PREFERRED EMBODIMENTS

Hereinafter, preferred embodiments of the present invention will be explained with reference to the accompanying drawings.

Figure 1:
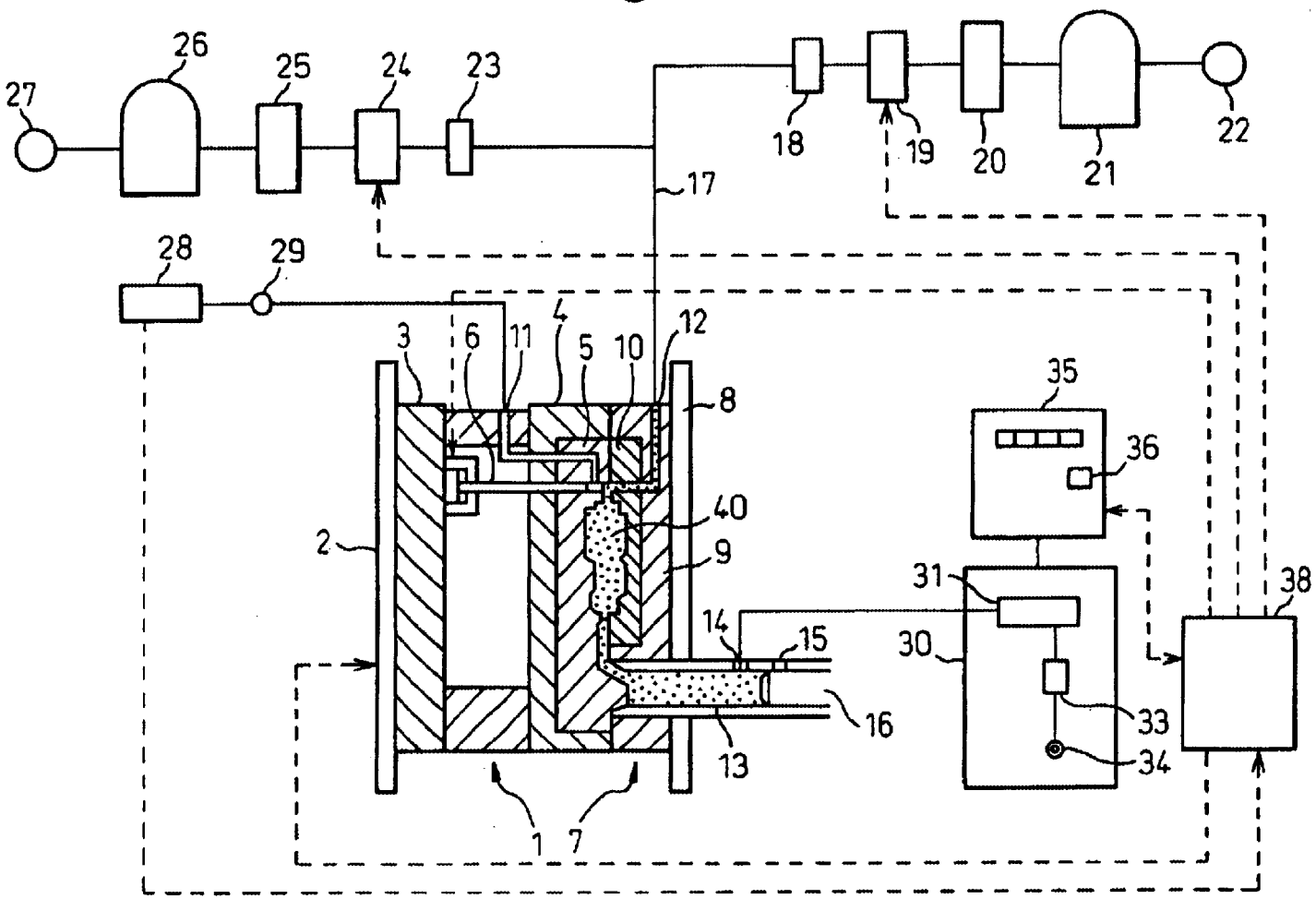
FIG. 1 is an overall structural view of a die casting machine according to the present invention.

FIG. 1 shows a die casting machine according to an embodiment of the present invention.

A mold comprises a movable mold 1 and a fixed mold 7, as shown in. FIG. 1. The fixed mold 7 comprises a fixed mother mold 9 and a fixed mold liner 10. The fixed mold liner 10 is fixed to the fixed mother mold 9 by a bolt, or the like. They are fixed to a fixed disc 8 of the die casting machine. The movable mold 1 comprises a movable mother mold 4 and a movable mold liner 5. The movable mold liner 5, that defines a cavity 40 with the fixed liner 10, is fixed to the movable mold 4 by a bolt, or the like. They are fitted to a movable disc 2 of the die casting machine through a die base 3.

One of the ends of the cavity 40 is connected to a sleeve 13 fixed to the fixed mother mold 9 and to the fixed disc 8. A powder mold releasing agent feeding port 14 and a molten charge feeding gate 15 are defined at an upper part of the sleeve 13. The powder mold releasing agent and the molten charge are supplied into the cavity 40 through the sleeve 13. A chip lubricant is supplied, too, from the molten charge feeding gate 15 as will be described later. The other end of the cavity 40 is connected to an exhaust passage 12. The exhaust passage 12 is connected to an evacuation passage 17 for evacuating the cavity 40.

A cut-off pin 6 is provided so that the connection portion between the exhaust passage 12 and the cavity 40 can be opened and closed. The cut-off pin 6 switches opening/closing of the connection portion between the exhaust passage 12 and the cavity 40 by utilizing oil pressure from an oil pressure feeding source, not shown.

A passage 11 is defined in such a manner as to branch from a sliding passage of the cut-off pin 6. A hose connects this passage 11 to a pressure gauge 28. This pressure gauge 28 indicates whether or not the vacuum inside the cavity 40 has reached a predetermined degree of vacuum when the molten charge is supplied into the cavity 40. A switching valve 29 is disposed in front of the pressure gauge 28. This valve 29 is closed when the powder mold releasing agent is supplied, and prevents the powder mold releasing agent from reaching the pressure gauge 28.

Two systems of evacuation mechanisms are connected to an exhaust passage 12 of the cavity 40 through the evacuation passage 17. The evacuation mechanism of the first system mainly comprises a vacuum tank 21 and a vacuum pump 22, and evacuates the cavity 40 to a predetermined degree of vacuum (−20 mmHg or 700 to 750 Torr) for sucking the powder mold releasing agent into the cavity 40. The capacity of the vacuum tank 21 is set to 100 L, for example. The evacuation mechanism of the second system mainly comprises a vacuum tank 26 and a vacuum pump 27. This mechanism evacuates the cavity 40 to a predetermined high vacuum (not higher than 60 Torr) for preventing the occurrence of mold cavities resulting from entrapment of air at the time of casting of the die cast products. The capacity of the vacuum tank 26 is set to 400 L, for example. The vacuum pump 27 has a greater capacity than the vacuum pump 22.

In these first and second evacuation mechanisms, the vacuum pumps 22 and 27 evacuate the respective vacuum tanks 21 and 26 so that the predetermined degrees of vacuum can be obtained in each cycle of die casting. Incidentally, the vacuum tanks 21 and 26 are connected to the cavity at different timings.

Solenoid valves 19 and 24 are disposed on the upstream side of the vacuum tanks 21 and 26 in the evacuation passage 17 to control connection/disconnection between the cavity 40 and the vacuum tanks 21 and 26, respectively.

Figure 2:
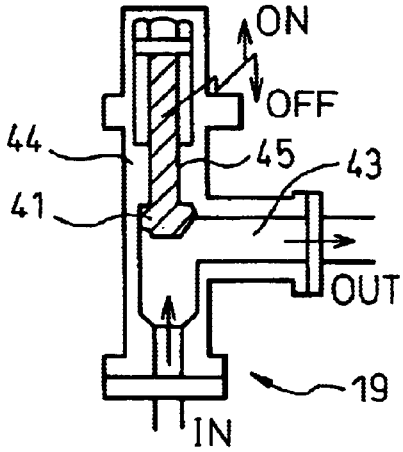
FIG. 2 is a schematic sectional view showing the schematic construction of a solenoid valve used for an evacuation mechanism of the die casting machine used in FIG. 1.

FIG. 2 shows the schematic construction of the solenoid valve 19. Incidentally, the solenoid valve 24 has the same construction as the solenoid valve 19. A substantially cylindrical space is defined inside a housing 44 of the solenoid valve 19, and a sliding portion 45 is slidably disposed inside this space. A valve body 41 is interconnected to the distal end of the sliding portion 45. The valve body 41 moves integrally with the sliding portion 45 inside the housing 44. A passage 43 that constitutes a part of the evacuation passage 17 is formed inside the housing 44 as shown in FIG. 2. A spring, not shown, for biasing the sliding portion 45 in FIG. 2 is disposed inside the housing 44. A solenoid, not shown, is also disposed inside the housing 44 for attracting the sliding portion 45 when power is supplied.

FIG. 2 shows the valve open state of the solenoid valve 19. This valve open state is established when powder is supplied to the solenoid and the sliding portion 45 slides up. As shown in FIG. 2, only the valve body 41 is exposed to the passage 43 under the valve open condition of the solenoid valve 19, but the sliding portion 45 is shielded by the valve body 41 from the passage 43. Therefore, even when an excessive amount of the powder mold releasing agent flows towards the vacuum tank 21, the mold releasing agent is prevented from adhering to the outer peripheral surface of the sliding portion 45. Since a sliding defect in the sliding portion 45 due to the powder releasing agent can thus be prevented, the solenoid valve 19 can reliably execute its opening/closing operation.

Figure 3:
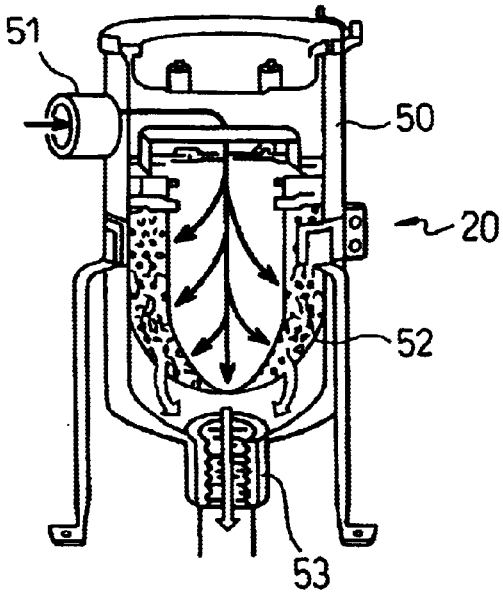
FIG. 3 is a partial exploded perspective view showing the construction of a bag filter.

Bag filters 20 and 25 are disposed between the solenoid valve 19 and the vacuum tank 21 and between the solenoid valve 24 and the vacuum tank 26, respectively. FIG. 3 is a partial sectional perspective view showing the schematic construction of this bag filter 20. Incidentally, the bag filter 25 has the same construction.

A bag-like filter element 52 is disposed inside a housing 50 having a suction port 51 and an exhaust port 53 as shown in FIG. 3. In this bag filter 20, a gas stream containing the powder mold releasing agent and sucked from the suction port 51 is filtered through the entire surface of the bag-like filter element 52 and is then discharged from the exhaust port 53. Since the bag filter 25 has a large filtration area, a drop in the vacuum suction effect of the vacuum tank 21 can be restricted.

The filter diameter (mesh size) of the filter element 52 is set to 3 $\mu$m because the mean grain diameter of the powder mold releasing agent is 8 $\mu$m, the minimum grain diameter is 4 $\mu$m and the maximum grain diameter is 12 $\mu$m. In other words, if the filter diameter of the filter element 52 is smaller than the minimum grain diameter of the powder mold releasing agent, the bag filter 20 can collect substantially all the powder mold releasing agent. Therefore, the filter diameter of the filter element is so selected as to satisfy this relationship.

Figure 4:
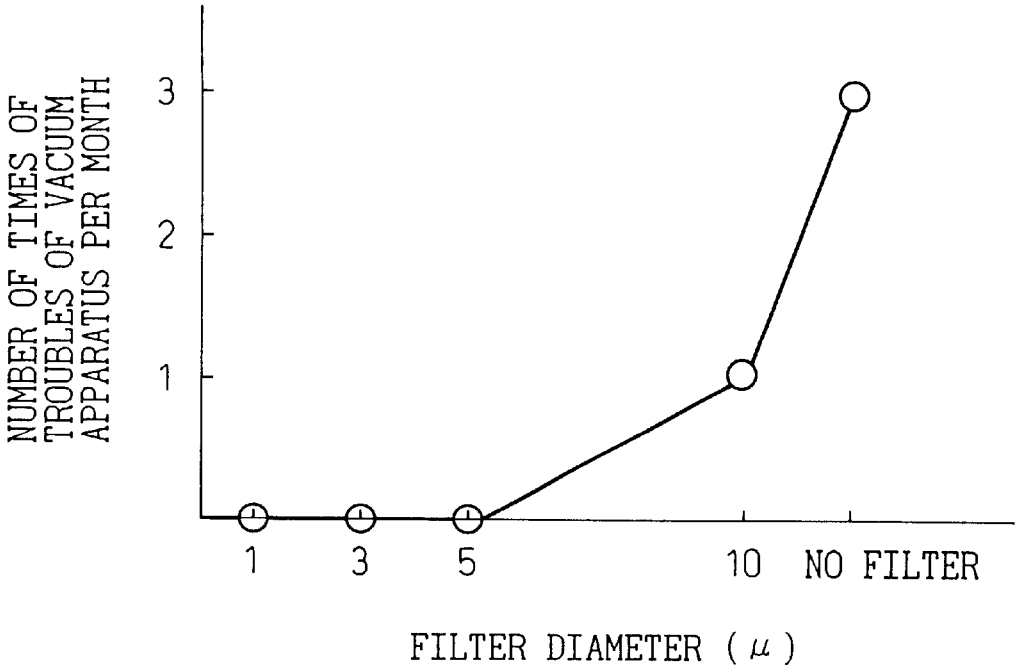
FIG. 4 is a graph showing the relationship between a filter diameter of a filter element of a bag filter and the number of times of troubles of a vacuum apparatus per month.

FIG. 4 is a graph showing the relationship between the filter diameter of the filter element 52 and the number of times trouble occurs in the vacuum apparatus, including the vacuum tank 21 and the vacuum pump 22, per month. It has been confirmed that when the bag filter 20 is not used, trouble in the vacuum apparatus occurs three times per month, but when the bag filter 20 is disposed and its filter diameter is small, the trouble less often. Particularly when the filter diameter of the filter element is 5 $\mu$m or below, no trouble occurs in the vacuum apparatus. Therefore, the filter can sufficiently exhibit its function even when the filter diameter of the filter element 52 is not smaller than the minimum grain diameter of the powder mold releasing agent. It can be utilized practically if the filter diameter is smaller than at least the mean grain diameter (8 μm) of the mold releasing agent.

Filters 18 and 23 having a relatively large filter diameter are disposed upstream of the solenoid valves 19 and 24, respectively. More concretely, filters having a filter diameter of 50 to 300 μm are used as the filters 18 and 23. These filters 18 and 23 are directed to collect relatively large foreign matters such as fins of the die cast products. These filters 18 and 23 can prevent operational defects of the solenoid valves 19 and 24 that result from invasion of relatively large foreign matter and can prolong the service life of the bag filters 20 and 25.

The die casting machine according to this embodiment further includes a powder feeding apparatus 30. The powder feeding apparatus 30 has a metering discharge portion 31 that meters the amount of the powder mold releasing agent to be supplied at one time, and discharges it to the powder mold releasing agent feeding port 14. The metering discharge portion 31 is connected to a positive pressure feeding source 34 through a solenoid valve 33. After a predetermined amount of the powder mold releasing agent is discharged, the metering discharge portion 31 applies the positive pressure from the positive pressure feeding source 34 into the cavity 40. In consequence, the powder mold releasing agent can be applied uniformly to the entire surface of the cavity 40. When the positive pressure is applied into the cavity 40 while the powder mold releasing agent is packed into the cavity 40, the powder mold releasing agent can be applied substantially uniformly to the entire surface of the cavity 40 even when the cavity 40 has a complicated shape.

A control panel 35 controls the operation of the powder feeding apparatus 30. The control panel 35 controls the operation of the metering discharge portion 31 of the powder feeding apparatus 30 and the switching operation of the solenoid valve 33. The control panel 35 includes a vacuum gauge 36. The internal pressure of the cavity 40 is applied to this vacuum gauge 36 through the powder feeding apparatus 30. The vacuum gauge 30 measures the degree of vacuum inside the cavity 40. The vacuum gauge 36 is used for measuring the degree of vacuum inside the cavity 40 particularly when the powder mold releasing agent is supplied.

Another control panel 38 is disposed to control the overall operations of the die casting machine. The control panel 38 controls the opening/closing operation of the solenoid valves 19 and 24 of the evacuation mechanisms, the opening/closing operations of the cut-off pin 6 and of the switching valve 29, the position control of the plunger 16, and the mold opening/clamping operations of the movable mold 2.

Hereinafter, the control of the control panels 35 and 38 will be explained with regard to the operation of the die casting machine. Incidentally, FIGS. 7A to 7D show the main operating conditions of the die casting machine.

Figure 5:
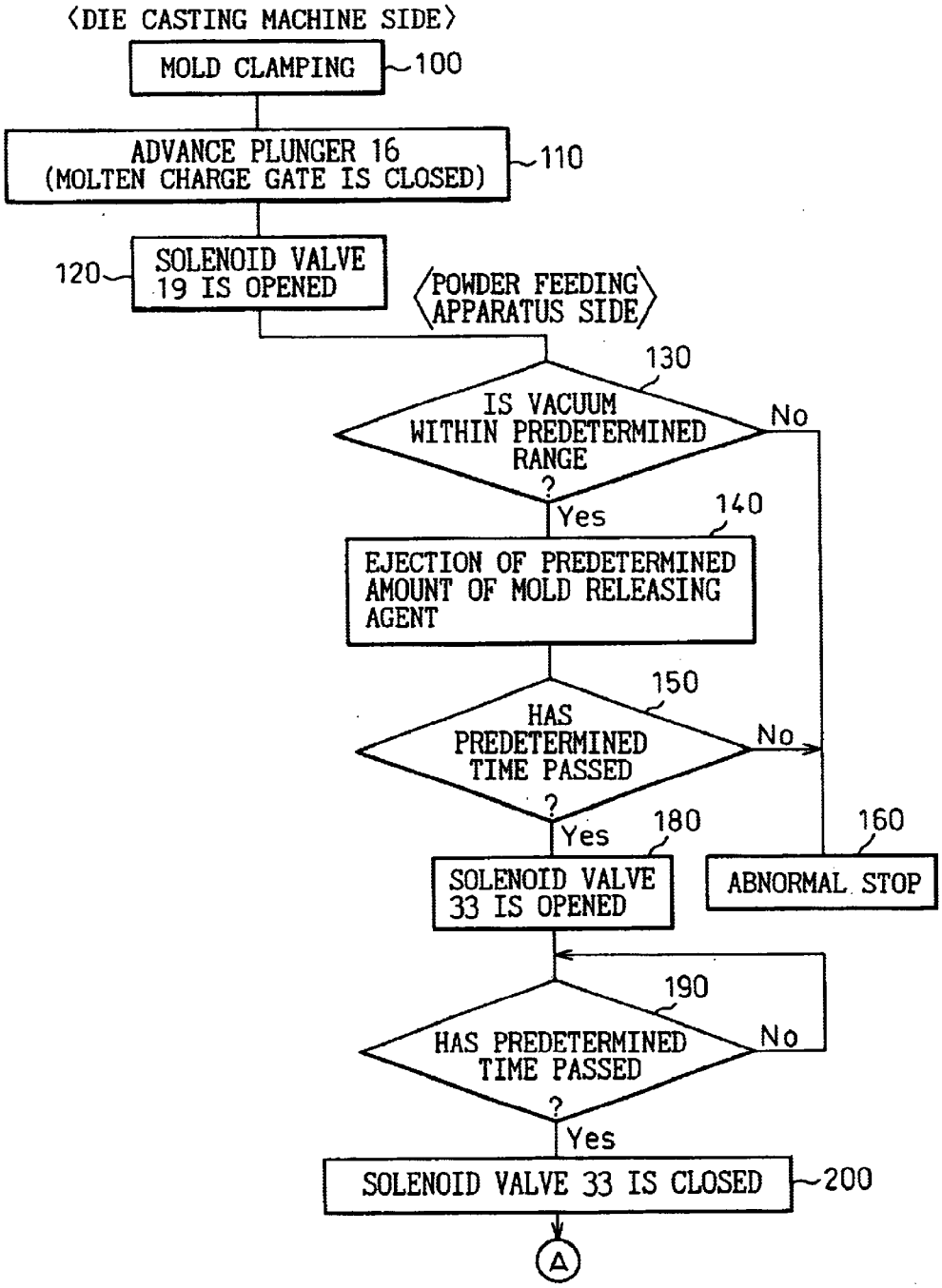
FIG. 5 is a flowchart showing the former half portion of control contents of control panels 35 and 38.

FIG. 5 is a flowchart showing the control the control panels 35 and 38. The control panel 38 for controlling the die casting machine and the control panel for controlling the feeding apparatus 30 of the powder mold releasing agent exchange data on the controlling condition through mutual communication.

In the first step 100, mold clamping of the movable mold 1 and the fixed mold 7 is effected. In the next step 110, the plunger 16 is moved to the position at which the molten charge gate 15 is closed. In step 120, the solenoid valve 19 is opened, and evacuation of the cavity 40 is started.

Opening of the solenoid valve 19 is notified to the to control panel 35 on the power feeding apparatus side. In step 130, the control panel 35 measures the degree of vacuum, using the vacuum gauge 36, after the passage of the time (several seconds) from opening of the solenoid valve 19 till the degree of vacuum necessary for sucking the powder mold releasing agent into the cavity 40 is acquired. When the degree of vacuum measured by the vacuum gauge 36 is outside a predetermined range (−20 mmHG or 700 to 750 Torr), the operation of the die casting machine is stopped on the assumption that an abnormality has developed in the vacuum apparatus, etc. (step 160). When the degree of vacuum so measured falls within the predetermined range, in step 140, a predetermined amount of the powder mold releasing agent is ejected from the metering discharge portion 31. The powder mold releasing agent is sucked into the cavity 40 through the powder mold releasing agent feeding port 14 and through the sleeve 13 (see FIG. 7A).

The degree of vacuum inside the cavity 40 is measured again in the next step 150 to judge whether or not the degree of vacuum so measured is within the predetermined range. The solenoid valve 19 is kept opened from the start till the end of the supply of the powder mold releasing agent. Therefore, if the powder mold releasing agent is supplied normally into the cavity 40, the degree of vacuum at the end point of the supply should fall within a predetermined higher vacuum range (350 to 450 Torr) than the degree of vacuum at the start of the supply. In other words, if the vacuum inside the cavity 40 at the end point of the supply is outside the predetermined range, it can be assumed that an abnormality such as clogging has occurred in the feed route of the powder mold releasing agent. Therefore, if the degree of vacuum measured in step 150 is outside the predetermined range, the die casting machine is stopped in step 160. When the measured vacuum falls within the predetermined range, on the other hand, the solenoid valve 33 is opened in step 180. In consequence, the positive pressure is applied into the cavity 40 from the positive pressure feeding source 34 through the solenoid valve 33, and the powder mold releasing agent packed into the cavity 40 is applied substantially uniformly to the entire surface of the cavity 40.

The control panel 38 closes the switching valve 29 and closes the solenoid valve 19 in synchronism with the opening operation of the solenoid valve 33.

The switching valve 29 is closed so that the excessive powder mold releasing agent can be prevented from being discharged from inside the cavity 40 and can be prevented from reaching the pressure gauge 28. In this case, the excess powder mold releasing agent stays inside the hose connecting the passage 11 to the switching valve 29. Since this hose is exchanged periodically, the measurement of the degree of vacuum by the pressure gauge 28 is not effected. As the switching valve 29 is closed, the degree of vacuum inside the vacuum tank 21 is prevented from dropping.

In the next step 190, whether or not the predetermined time has passed is judged. If it has, the solenoid valve 33 is closed in step 200 and the application of the positive pressure is completed. As for the level and the time of the positive pressure applied this time, a positive pressure of about 2 to 8 kg/cm$^2$ is applied for several seconds.

Figure 6:
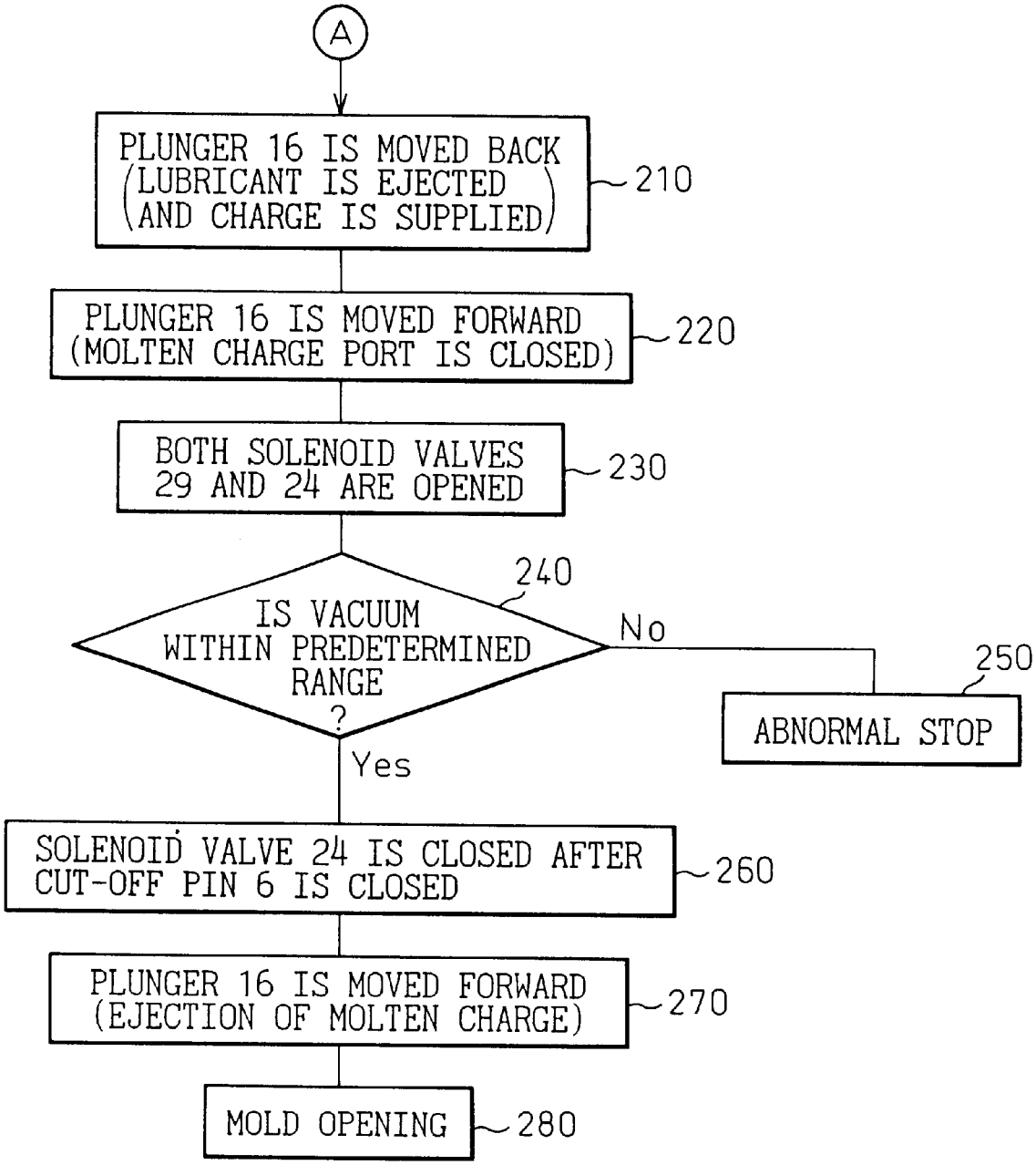
FIG. 6 is a flowchart showing the latter half portion of the control contents of the control panels 35 and 38.

Closing of the solenoid valve 33 is reported to the control panel 38 on the die casting machine side. The control panel 38 moves the plunger 16 back and opens the molten charge gate 15 in step 210 (see FIG. 6). The chip lubricant is ejected under this state from the molten charge gate 15 through the chip lubricant nozzle 39 (see FIG. 7B). This chip lubricant insures smooth sliding of the plunger 16. "Glaface P1200N" (a product of Haruno Shoji K. K.), for example, can be used.

The chip lubricant is a liquid and has viscosity. Therefore, assuming that the powder mold releasing agent is supplied from the powder mold releasing agent feeding port 14 after the chip lubricant is supplied to the sleeve 13, the powder mold releasing agent adheres to the chip lubricant and aggregates. Then, the powder mold releasing agent so aggregating is pushed into the cavity 40 with the molten charge when the molten charge is ejected from the sleeve 13 into the cavity 40, and mixes into the die cast product. This mixture remarkably deteriorates quality of the die cast product.

To solve this problem, the mold releasing agent is sucked into the cavity 40 before the chip lubricant is supplied to the sleeve 13 in this embodiment. In consequence, when the powder mold releasing agent is supplied first into the cavity 40, the quantity of the remaining powder in the sleeve 13 can be reduced to about ⅛ in comparison with the case where the chip lubricant is first supplied to the sleeve 13.

Figure 7A:
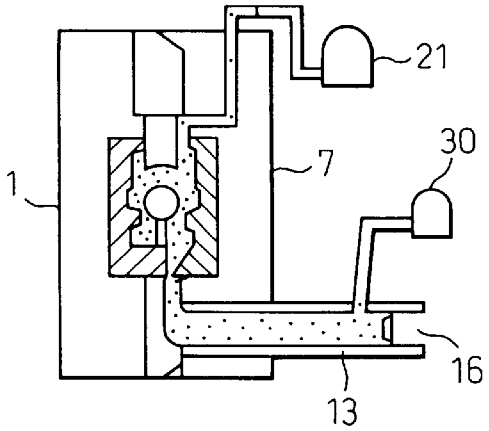
FIGS. 7A to 7D is an explanatory view showing a main operation process of a die casting machine.
Figure 7B:
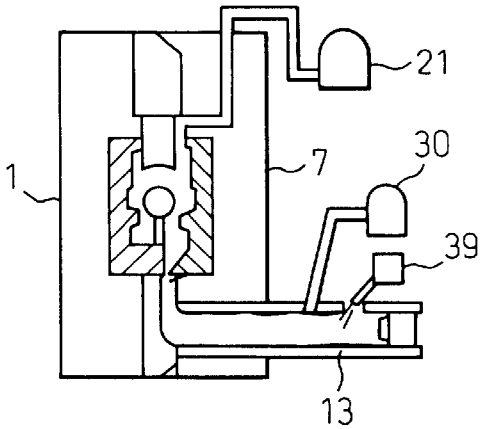
Figure 7C:
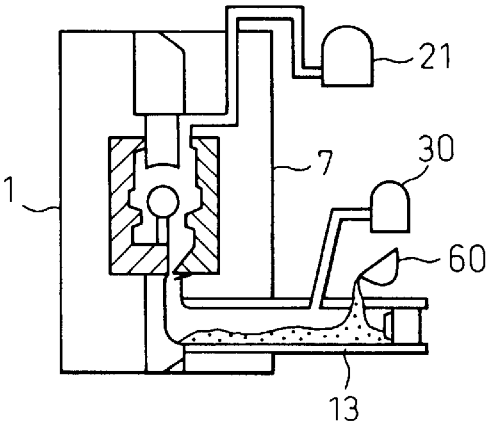

After the chip lubricant is supplied, the molten charge is poured into the sleeve 13 from the molten charge gate 15 by a ladle 60 (see FIG. 7C). In step 220, the plunger 16 is moved to the position at which the molten charge gate 15 is closed, and the inside of the sleeve is kept air tight.

Under this state, the solenoid valve 24 is opened and the switching valve 29 is opened (step 230). In consequence, the cavity 40 is evacuated to a predetermined high vacuum (60 Torr or below), and the degree of vacuum can be measured by the vacuum gauge 28. When the time necessary for acquiring the predetermined high vacuum has passed after the solenoid valve 24 was opened, the degree of vacuum inside the cavity 40 is measured by the vacuum gauge 28. If the degree of vacuum so measured does not reach the predetermined high vacuum (step 240), the die casting machine is stopped on the assumption that an abnormality has occurred in the casting machine (step 250). When the degree of vacuum measured reaches the predetermined high vacuum, on the other hand, the cut-off pin 6 is moved to the position at which the connection portion between the cavity 40 and the exhaust passage 12 is closed in step 260. The solenoid valve 24 is then closed. In consequence, the molten charge ejected into the cavity 40 is prevented from flowing out to the exhaust passage 12, and so forth.

Figure 7D:
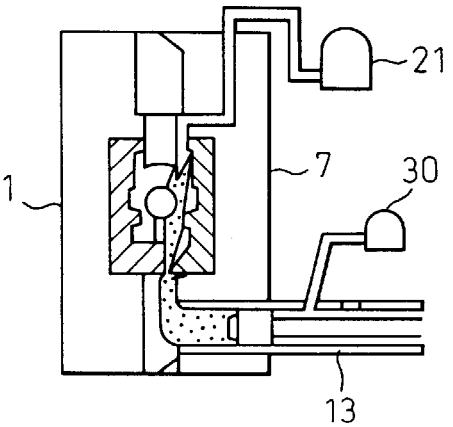

In step 270, the plunger 16 is moved at a high speed so that the molten charge is ejected from the sleeve 13 into the cavity 40 (see FIG. 7D). Thereafter, the plunger 16 is moved back to the initial position when the molten charge inside the cavity is solidified.

In step 280, the movable mold 1 is moved and mold is opened. The resulting die cast product is withdrawn from the mold.

A series of operations described above provide the die cast product, and are repeatedly carried out.

When the series of operations are repeatedly carried out, the mold temperature at the time of withdrawal of the die cast produces reaches about 400 to about 500° C. because the temperature of the molten charge is about 700° C. Therefore, the mold temperature remains high even when the casting cycle shifts to the next cycle.

As a result of studies, the inventors of the present invention have clarified that adhesion of the powder mold releasing agent to the mold drops at a high temperature at which the mold temperature exceeds 300° C. Therefore, a plurality of cooling pipes are disposed inside both movable mold 1 and fixed mold 7 in the same way as in the conventional molds so that the mold can be cooled when cooling water is caused to flow through the cooling pipes.

Here, the surface of the cavity 40 of the mold to which the powder mold releasing agent adheres is the portion that is heated to the highest temperature by the molten charge. Therefore, in this embodiment, the number of cooling pipes and the positions of their formation are selected so that they have a cooling capacity capable of cooling the surface temperature of the cavity 40 down to 300° C. or below before the powder mold releasing agent is supplied. In this way, the drop of adhesion of the powder mold releasing agent can be prevented.

Incidentally, the powder mold releasing agent used in this embodiment is a mixture prepared by mixing 80% of talc and 20% of wax. An aluminum molten charge or a magnesium molten charge can be used as molten charges.

While the invention has been described by reference to specific embodiments chosen for purposes of illustration, it should be apparent that numerous modifications could be made thereto by those skilled in the art without departing from the basic concept and scope of the present invention.

What is claimed is:

1. A die casting machine comprising:

a mold including a fixed mold and a movable mold and forming a cavity when said fixed mold and said movable mold are clamped;

powder mold releasing agent feeding means for supplying a powder mold releasing agent into said cavity;

first evacuation means, connected to said cavity through a first evacuation passage, for evacuating the inside of said cavity to a first predetermined degree of vacuum and sucking said powder mold releasing agent supplied from said powder mold releasing agent feeding means into said cavity, wherein said first evacuation means comprises:

a first vacuum tank;

a first vacuum pump for evacuating said first vacuum tank;

first switching means disposed in said first evacuation passage upstream of said first vacuum tank for switching connection/disconnection of said cavity and said first vacuum tank by opening/closing said first evacuation passage;

second evacuation means, connected to said cavity through a second evacuation passage, for evacuating the inside of said cavity to a second predetermined degree of vacuum higher than said first degree of vacuum after said powder mold releasing agent is applied to the surface of said cavity;

wherein said second evacuation means comprises:

a second vacuum tank;

a second vacuum pump for evacuating said second vacuum tank; and second switching means disposed in said second evacuation passage upstream of said second vacuum tank for switching connection/disconnection of said cavity and said second vacuum tank; and wherein said second switching means is closed when said first switching means is opened, and said first switching means is closed when said second switching means is opened;

molten charge feeding means for supplying a molten charge into said cavity when the inside of said cavity is evacuated to said second predetermined degree of vacuum by said second evacuation means; and wherein each of the first evacuation means and the second evacuation means has a vacuum tank and a vacuum pump.

2. A die casting machine according to claim 1, wherein said second vacuum pump has a capacity greater than that of said first vacuum pump.

3. A die casting machine according to claim 1, wherein:

a first filter further is disposed between said first switching means and said first vacuum tank; and a second filter further is disposed between said second switching means and said second vacuum tank.

4. A die casting machine according to claim 3, wherein the filter diameters of said first and second filters are set to a value smaller than the minimum grain diameter of said powder mold releasing agent.

5. A die casting machine according to claim 1, wherein each of said first and second switching means comprises a solenoid valve, and a sliding portion interconnected to a valve body thereof is shielded from said first or second evacuation passage when said valve body is open.

6. A die casting machine according to claim 1, wherein said molten charge feeding means comprises a sleeve for introducing said molten charge into said cavity, a plunger for ejecting said molten charge into said cavity when said molten charge is supplied to said sleeve, and lubricant feeding means for supplying a lubricant for said plunger sliding inside said sleeve;

wherein said powder mold releasing agent feeding means supplies said powder mold releasing agent into said cavity through said sleeve; and wherein said powder mold releasing agent feeding means supplies said lubricant into said sleeve after said powder mold releasing agent feeding means finishes supplying said powder mold releasing agent.

7. A die casting machine according to claim 1, further comprising a cooling mechanism for cooling the surface temperature of said mold to 300° C. or below before said powder mold releasing agent feeding means supplies said powder mold releasing agent.

8. A die casting machine according to claim 7, wherein said cooling mechanism comprises cooling pipes which are formed inside said mold and through which cooling water flows, and said cooling mechanism cools the surface temperature of said cavity of said mold to 300° C. or below after a die cast product is withdrawn from said mold and before said powder mold releasing agent is supplied.

9. A die casting machine according to claim 1, wherein said first evacuation means evacuates said inside of said cavity to a degree of vacuum of 700 to 750 Torr and said second evacuation means evacuates said inside of said cavity to a degree of vacuum of less than or equal to 60 Torr.

10. The die casting machine of claim 1, further comprising:

a first filter disposed between said cavity and said first evacuation means, and having a filter mesh diameter smaller than at least a mean grain diameter of said powder mold releasing agent;

a second filter disposed between said cavity and said second evacuation means, and having a filter diameter smaller than at least a mean grain diameter of said powder mold releasing agent;

a third filter disposed in said first evacuation passage between said cavity and said first evacuation means, and having a filter diameter greater than that of said first filter; and a fourth filter disposed in said second evacuation passage between said cavity and said second evacuation means, and having a filter diameter greater than that of said second filter.

* * * * *